US006041208A

United States Patent [19]

Choi

[11] Patent Number: 6,041,208

[45] Date of Patent: Mar. 21, 2000

[54] METHOD AND ARRANGEMENT FOR RETRIEVING/SUPPLYING DEVELOPING MATERIAL IN ELECTROPHOTOGRAPHY FORMING APPARATUS

[75] Inventor: Bong-Hwan Choi, Suwon, Rep. of Korea

[73] Assignee: SamSung Electronics Co., Ltd., Kyungki-do, Rep. of Korea

[21] Appl. No.: 09/055,922

[22] Filed: Apr. 7, 1998

[30] Foreign Application Priority Data

Apr. 7, 1997 [KR] Rep. of Korea ..... 97-12638

[51] Int. Cl.[7] ..... G03G 15/08

[52] U.S. Cl. ..... 399/281; 399/260; 399/283; 399/284; 399/285

[58] Field of Search ..... 399/281, 285, 399/286, 260, 283, 284, 273, 274, 272

[56] References Cited

U.S. PATENT DOCUMENTS

| | | | |
|---|---|---|---|
| 4,277,003 | 7/1981 | Tabuchi et al. . | |
| 4,480,911 | 11/1984 | Itaya et al. . | |
| 4,522,481 | 6/1985 | Imai et al. . | |
| 4,545,669 | 10/1985 | Hays et al. . | |
| 4,714,942 | 12/1987 | Nahanishi . | |
| 4,733,267 | 3/1988 | Enoki et al. | 355/3 DD |
| 4,811,686 | 3/1989 | Yamane . | |
| 4,878,088 | 10/1989 | Nakanishi et al. . | |
| 4,912,513 | 3/1990 | Oka et al. . | |
| 4,947,212 | 8/1990 | Ikegawa et al. . | |
| 5,032,872 | 7/1991 | Folkins et al. . | |
| 5,223,668 | 6/1993 | Takaya et al. | 355/281 |
| 5,333,040 | 7/1994 | Imamiya . | |
| 5,387,963 | 2/1995 | Kajimoto et al. | 355/215 |
| 5,420,668 | 5/1995 | Okano . | |
| 5,473,417 | 12/1995 | Hirano | 399/281 |
| 5,526,099 | 6/1996 | Katakabe . | |
| 5,671,465 | 9/1997 | Kimura et al. . | |
| 5,678,143 | 10/1997 | Nagahara et al. . | |
| 5,717,981 | 2/1998 | Yamanaka . | |
| 5,726,695 | 3/1998 | Ueda . | |
| 5,729,267 | 3/1998 | Shimada et al. . | |
| 5,809,386 | 9/1998 | Iwata | 399/281 |
| 5,812,917 | 9/1998 | Iwata et al. | 399/281 |

*Primary Examiner*—Richard Moses
*Attorney, Agent, or Firm*—Robert E. Bushnell, Esq.

[57] ABSTRACT

A method for separately retrieving used developing material on a developing roller and supplying new developing material, while balancing the retrieval of the used developing material with the supply of the new developing material in accordance with an increase in the number of papers being printed. The method is directed to retrieving and supplying developing material in an electrophotography forming apparatus which includes a developing roller, a retrieval roller and a supply roller. The method includes the steps of: rotating the retrieval roller connected to the developing roller in the same direction as the direction of rotation of the developing roller; and applying voltages to the developing roller, the retrieval roller and the supply roller in accordance with a predetermined relationship.

15 Claims, 1 Drawing Sheet

METHOD AND ARRANGEMENT FOR RETRIEVING/SUPPLYING DEVELOPING MATERIAL IN ELECTROPHOTOGRAPHY FORMING APPARATUS

CLAIM OF PRIORITY

This application makes reference to, incorporates the same herein, and claims all benefits accruing under 35 U.S.C. §119 from an application for *METHOD FOR RETRIEVING/SUPPLYING DEVELOPING MATERIAL IN ELECTROPHOTOGRAPHY FORMING APPARATUS* earlier filed in the Korean Industrial Property Office on the $17^{th}$ of Apr. 1997 and there duly assigned Serial No. 12638/1997.

BACKGROUND OF THE INVENTION

1. Technical Field

The present invention relates to a developing device of an output apparatus using an electrophotography processor and, more specifically, to a method and arrangement for separately retrieving used developing material on a developing roller and supplying new developing material while balancing the retrieval of the used developing material with the supply of the new developing material in accordance with an increase in the number of papers being printed.

2. Related Art

Typically, a cleanerless developing system has a supply roller connected to a developing roller for performing the retrieval of used toner, as well as supply and friction-charging of the new toner. In such systems, the functions of retrieving used toner, supplying new toner and friction-charging the toner are simultaneously performed.

However, in such a system, there is a problem in that it is difficult to properly set the level of the power supply which supplies power to the supply roller of such a system, the supply roller being made of semiconductive elastic sponge. Furthermore, such systems have a limited design in that they cannot achieve a balance between the supply of the toner and retrieval of the toner while varying the resistance of the roller in accordance with an increase in the number of papers being printed. As a result, such systems are incapable of obtaining a stable image.

Therefore, there is a need for the development of a method for retrieving/supplying developing material in an electrophotography forming apparatus, and in particular, there is a need to provide a method for separately retrieving used developing material on a developing roller and supplying new developing material, while at the same time balancing the retrieval of the used developing material with the supplying of a new developing material in accordance with an increase in the number of pages or papers being printed.

The following patents are considered to be representative of the prior art relative to the present invention, and are burdened by the disadvantage discussed above: U.S. Pat. No. 5,729,267 to Shimada et al., entitled *Image Forming Apparatus Having Image Transfer With Toner Cleaning Function*, U.S. Pat. No. 5,726,695 to Ueda, entitled *Developing Device*, U.S. Pat. No. 5,717,981 to Yamanaka, entitled *Developing Device For Electrophotographic Image Forming Apparatus*, U.S. Pat. No. 5,678,143 to Nagahara et al., entitled *Image Forming Apparatus For Collecting Residual Toner From A Drum Using An AC Voltage*, U.S. Pat. No. 5,671,465 to Kimura et al., entitled *Image Forming Apparatus Having A Revolver Type Developing Device*, U.S. Pat. No. 5,526,099 to Katakabe, entitled *Developing Device And An Image Forming Apparatus Using The Same*, U.S. Pat. No. 5,473,417 to Hirano, entitled *Developing Apparatus Having Toner Supply Roller Applied With Bias Voltage Varied In Accordance With Changes In Physical Properties Thereof*, U.S. Pat. No. 5,420,668 to Okano, entitled *Image Forming Apparatus*, U.S. Pat. No. 5,333,040 to Imamiya, entitled *Developing Device Having Improved Toner Transport Capacity For Use In An Image Forming Apparatus*, U.S. Pat. No. 5,032,872 to Folkins et al., entitled *Developing Device With Dual Donor Rollers Including Electrically Biased Electrodes For Each Donor Roller*, U.S. Pat. No. 4,947,212 to Ikegawa et al, entitled *Developing Apparatus With Color Dependent Toner Supply Voltage*, U.S. Pat. No. 4,912,513 to Oka et al., entitled *Developing Apparatus With Variable Developing Bias Voltage*, U.S. Pat. No. 4,714,942 to Nakanishi, entitled *Reversal Image Development Type Electrophotographic Printing System*, U.S. Pat. No. 4,878,088 to Nakanishi entitled *Developing Unit Of Electrophotographic Apparatus*, U.S. Pat. No. 4,811,686 to Yamane, entitled *Developing Device Of An Electrophotographic Machine*, U.S. Pat. No. 4,545,669 to Hays et al., entitled *Low Voltage Electrophotography With Simultaneous Photoreceptor Charging, Exposure And Development*, U.S. Pat. No. 4,522,481 to Imai et al., entitled *Toner Supply Control Method For Electrophotographic Copier*, U.S. Pat. No. 4,480,911 to Itaya et al., entitled *Developing Apparatus And A Developing Method Of An Electrostatic Image*, and U.S. Pat. No. 4,277,003 to Tabuchi et al., entitled *Developing Material Supplying Device.*

SUMMARY OF THE INVENTION

It is an object of the present invention to provide a method and arrangement for separately retrieving used developing material on a developing roller and supplying new developing material, while balancing the retrieval of the used developing material with the supply of the new developing material in accordance with an increase in the number of papers being printed.

In order to achieve the above object, the present invention is provided with a method for retrieving/supplying developing material in an electrophotography forming apparatus including a developing roller, a retrieval roller and a supply roller, the method including the steps of: rotating the retrieval roller connected with the developing roller in the same direction as the rotating direction of the developing roller; and applying voltages to the developing roller, the retrieval roller and the supply roller according to the following expression 1.

$$Vr>Vd>Vs \qquad \text{[Expression 1]}$$

Vr: voltage applied the retrieval roller

Vd: voltage applied to the developing roller

Vs: voltage applied to the supply roller

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENT(S)

Figure 1:
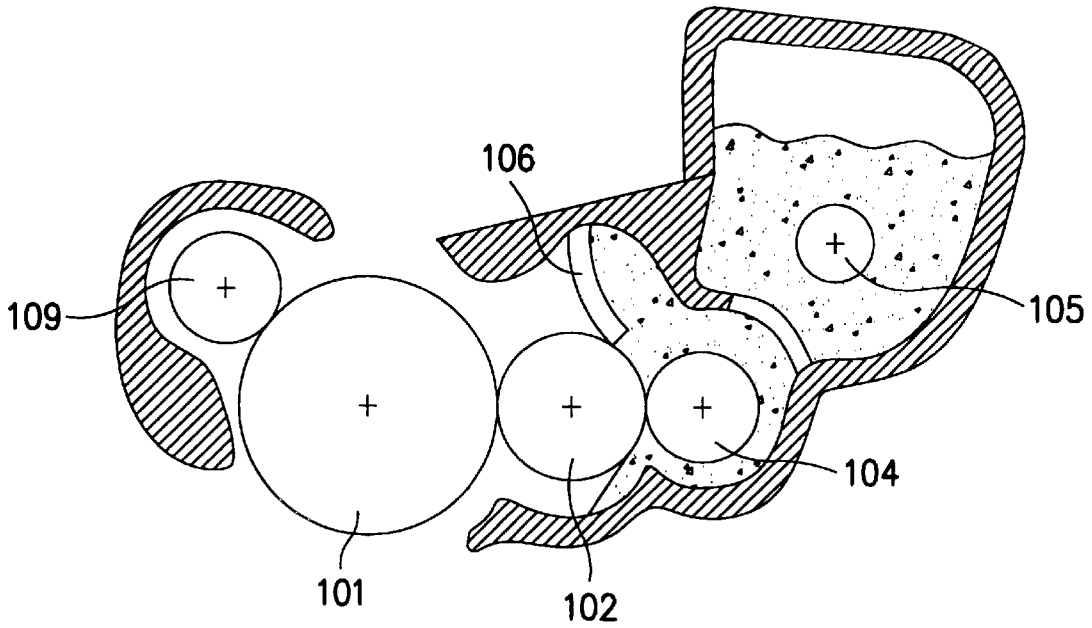
FIG. 1 is a diagram showing a cleanerless developing system.

Hereinafter, a preferred embodiment of the present invention will be concretely explained with reference with accompanying drawings. Most of all, throughout the drawings, it is noted that the same reference numerals of letter will be used to designate like or equivalent elements having the same function. Further, the detailed description on known function and constructions unnecessarily obscuring the subject matter of the present invention will be avoided in the present invention.

FIG. 1 is a diagram showing a cleanerless developing system, wherein a supply roller 104 is connected to a developing roller 102 performing the retrieval of the used toner, and supplies and friction-charges the new toner, that is, simultaneously performs the functions of retrieving the used toner on the developing roller 102, supplying the new toner, and friction-charging the toner. However, there is a problem in that it is difficult to properly set the level of the power supply to the supply roller 104, which is made of semiconductive elastic sponge. That is why the positive (+) potential applied to the supply roller 104 to retrieve the negative (−) toner used on the developing roller 102 should be higher than the potential applied to the developing roller 102, and the negative (−) potential applied thereto should be lower than the potential applied to the supply roller 104 to supply and friction-charge the toner. However, the system of FIG. 1 has a limited design and cannot balance the supply of toner with the retrieval of toner while varying the resistance of the roller in accordance with an increase in the number of papers being printed, and is thereby incapable of obtaining a stable image.

Figure 2:
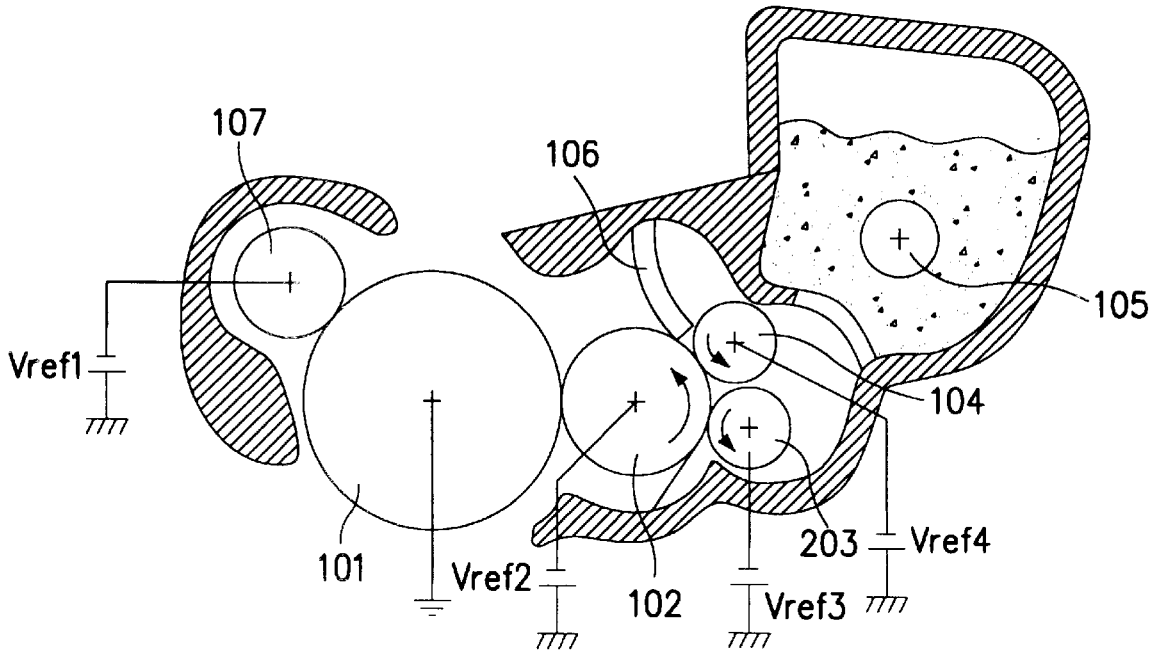
FIG. 2 is a diagram showing the state where the used toner of the developing roller is retrieved and the new toner is supplied according to a preferred embodiment of the present invention.

FIG. 2 is a diagram showing the state where the used toner of the developing roller is retrieved and the new toner is supplied according to a preferred embodiment of the present invention. The arrangement of FIG. 2 includes a photosensitive unit 101 for forming an electrostatic latent image, a charge roller 107 for charging the photosensitive unit 101, a developing roller 102 for developing the toner at an exposing unit (at the latent image), a doctor blade 106 for doctoring the toner layer on the developing roller 102, a retrieval roller 203 for retrieving the used toner on the developing roller 102, a supply roller toner hopper for supplying and friction-charging the new toner on the developing roller 102, and an agitator 105 for supplying the toner.

A detailed embodiment of the present invention will now be concretely explained with reference to FIG. 2.

The toner on the developing roller 102, as formed by means of the doctor blade 106 of FIG. 2, is developed at a nip of the photosensitive unit 101. The remaining toner is retrieved at a nip of the supply roller 104. In order to ensure separation of the retrieval of the toner from the supply of the new toner, the retrieval roller 203 only retrieves the used toner formed on the developing roller 102, and the supply roller 104 supplies and friction-charges the new toner.

Meanwhile, the retrieval roller 203 has a voltage Vr of higher potential than the bias voltage Vd applied at a power supply terminal Vref2 of the developing roller 102, while rotating (counterclockwise) in the same direction as the rotating direction of the developing roller 102, thereby improving the capacity of retrieving the negative (−) toner. The supply roller 104 friction-charges the toner and applies a bias voltage Vs of lower potential than the developing bias voltage Vd so as to supply new toner while rotating (counterclockwise) in the same direction as the rotating direction of the developing roller 102, thereby improving the capacity to supply the toner.

Accordingly, the relationship of the developing bias voltage Vd applied to the power supply terminal Vref2 of the developing roller 102, the supply bias voltage Vs applied to the power supply terminal Vref4 of the supply roller 104, and the retrieval bias voltage Vr applied to the power supply terminal Vref3 of the retrieval roller 203 will be given in following expression 1.

$$Vr > Vd > Vs \qquad \text{[Expression 1]}$$

Vr: voltage applied the retrieval roller

Vd: voltage applied to the developing roller

Vs: voltage applied to the supply roller

For instance, when the developing bias voltage Vd is −300V, the bias voltage Vr of the retrieval roller 203 should be −200V and the supply bias voltage Vs of the supply roller 104 should be −400V to satisfy the above expression 1.

As is apparent from the foregoing, the present invention can constantly obtain an image of high quality owing to improvement in the capacity to retrieve used toner and supply new toner. That is why the toner is easily deteriorated and the image quality is deteriorated by the friction of the blade or the supply roller if the used toner continuously remains on the developing roller.

Therefore, it should be understood that the present invention is not limited to the particular embodiment disclosed herein as the best mode contemplated for carrying out the present invention, but rather that the present invention is not limited to the specific embodiments described in this specification, except as defined in the appended claims.

What is claimed is:

1. A method for retrieving and supplying developing material in an electrophotography forming apparatus which includes a developing roller, a retrieval roller and a supply roller, said method comprising the steps of:

rotating said retrieval roller adjacent to said developing roller in a direction identical to a direction of rotation of said developing roller; and applying voltages to said developing roller, said retrieval roller and said supply roller according to following expression:

$$Vr > Vd > Vs$$

where

Vr is the voltage applied to the retrieval roller,

Vd is the voltage applied to the developing roller, and

Vs is the voltage applied to the supply roller.

2. The method as recited in claim 1, wherein said retrieval roller separately and exclusively retrieves used developing material from said developing roller.

3. The method as recited in claim 2, wherein said supply roller separately and exclusively supplies new developing material to said developing roller.

4. A method for retrieving and supplying developing material in an electrophotography forming apparatus which includes a developing roller, a retrieval roller and a supply roller, comprising the steps of:

separating retrieval of used developing material from said developing roller from supply and friction-charging of new developing material; and constantly balancing the retrieval of the used developing material with the supply of the new developing material in accordance with an increase in the number of papers being printed.

5. The method as recited in claim 4, wherein said retrieval roller separately and exclusively retrieves used developing material from said developing roller.

6. The method as recited in claim 5, wherein said supply roller separately and exclusively supplies new developing material to said developing roller.

7. An arrangement for retrieving and supplying developing material in an electrophotography forming apparatus, said arrangement comprising:

developing roller means for using developing material in a developing process;

supply roller means located adjacent to said developing roller means for supplying new developing material to said developing roller means; and retrieval roller means located adjacent to said developing roller means and said supply roller means for retrieving used developing material forming said developing roller means;

wherein said retrieval roller means separately and exclusively retrieves used developing material from said developing roller means;

said arrangement further comprising voltage supply means for supplying voltages to said developing roller means, said supply roller means and said retrieval roller means, respectively; and wherein said voltage applied to said retrieval roller means is greater than said voltage applied to said developing roller means, and said voltage applied to said developing roller means is greater than said voltage applied to said supply roller means.

8. The arrangement as recited in claim 7, further comprising rotating means for rotating at least two of said developing roller means, said supply roller means and said retrieval roller means; and wherein said rotating means rotates said retrieval roller means in a direction identical to a direction of rotation of said developing roller means.

9. The arrangement as recited in claim 7, further comprising a doctor blade disposed adjacent to said developing roller means and said supply roller means.

10. The arrangement as recited in claim 7, further comprising a photosensitive unit disposed adjacent to said developing roller means.

11. The arrangement as recited in claim 7, wherein said supply roller means separately and exclusively supplies new developing material to said developing roller means.

12. An arrangement for retrieving and supplying developing material in an electrophotography forming apparatus, said arrangement comprising:

developing roller means for using developing material in a developing process;

supply roller means located adjacent to said developing roller means for supplying new developing material to said developing roller means; and retrieval roller means located adjacent to said developing roller means and said supply roller means for retrieving used developing material from said developing roller means;

wherein retrieval of used developing material by said retrieval roller means is constantly balanced with supply of new developing material by said supply roller means in accordance with an increase in the number of papers been printed.

13. A method for retrieving and supplying developing material in an electrophotography forming apparatus which includes a developing roller, a retrieval roller and a supply roller, comprising the steps of:

retrieving used developing material from said developing roller;

supplying new developing material to said developing roller;

friction-charging the new developing material; and constantly balancing the retrieval of the used developing material with the supply of the new developing material in accordance with an increase in the number of papers being printed.

14. The method as recited in claim 13, wherein at least two of said retrieving, supplying and friction-charging steps are separately performed.

15. The method as recited in claim 14, wherein all of said retrieving, supplying and friction-charging steps are separately performed.

* * * * *